US005658704A

United States Patent [19]

Patel et al.

[11] Patent Number: 5,658,704

[45] Date of Patent: Aug. 19, 1997

[54] TONER PROCESSES

[75] Inventors: Raj D. Patel; Guerino G. Sacripante, both of Oakville; Daniel A. Foucher, Toronto, all of Canada

[73] Assignee: Xerox Corporation, Stamford, Conn.

[21] Appl. No.: 663,414

[22] Filed: Jun. 17, 1996

[51] Int. Cl.[6] ..... G03G 9/087

[52] U.S. Cl. ..... 430/137; 524/605; 430/904

[58] Field of Search ..... 430/137; 524/605

[56] References Cited

U.S. PATENT DOCUMENTS

| | | | |
|---|---|---|---|
| 3,910,846 | 10/1975 | Azar et al. | 524/605 |
| 4,116,924 | 9/1978 | Peabody | 524/605 |
| 4,279,802 | 7/1981 | Laely et al. | 524/605 |
| 4,983,488 | 1/1991 | Tan et al. | 430/137 |
| 4,996,127 | 2/1991 | Hasegawa et al. | 430/109 |
| 5,290,654 | 3/1994 | Sacripante et al. | 430/137 |
| 5,346,797 | 9/1994 | Kmiecik-Lawrynowicz et al. | 430/137 |
| 5,348,832 | 9/1994 | Sacripante et al. | 430/109 |
| 5,423,432 | 6/1995 | Krutak et al. | 524/605 |

FOREIGN PATENT DOCUMENTS 7-261460 10/1995 Japan .

*Primary Examiner*—Christopher D. Rodee
*Attorney, Agent, or Firm*—E. O. Palazzo

[57] ABSTRACT

A process for the preparation of toner comprised of i) flushing pigment into a sulfonated polyester resin, and which resin has a degree of sulfonation of from between about 0.5 and about 2.5 mol percent based on the repeat unit of the polymer;

ii) dispersing the resulting pigmented sulfonated polyester resin in warm water, which water is at a temperature of from about 40° to about 95° C., and which dispersing is accomplished by a high speed shearing polytron device operating at speeds of from about 100 to about 5,000 revolutions per minute thereby enabling the formation of toner sized particles, and which particles are of a volume average diameter of from about 3 to about 10 microns with a narrow GSD;

iii) recovering said toner by filtration;

iv) drying said toner by vacuum; and v) optionally adding to said dry toner charge additives and flow aids.

17 Claims, No Drawings

TONER PROCESSES

PENDING APPLICATIONS

Illustrated in copending patent application U.S. Ser. No. 663,420 pending, filed concurrently herewith, the disclosure of which is totally incorporated herein by reference, is a process for the preparation of toner compositions comprised of i) flushing pigment into a sulfonated polyester resin and which resin has a degree of sulfonation of from between about 2.5 and about 20 mol percent based on the repeat unit of the polymer;

ii) dispersing the resulting pigmented sulfonated polyester resin in warm water, which water is at a temperature of from about 40° to about 95° C., and which dispersing is accomplished by a high speed shearing polytron device operating at speeds of from about 100 to about 5,000 revolutions per minute thereby enabling the formation of toner sized particles, and which particles are of a volume average diameter of from about 3 to about 10 microns with a narrow GSD; adding an alkali halide solution iii) recovering said toner particles by filtration;

iv) drying said toner particles by vacuum; and v) optionally adding to said dry toner particles charge additives and flow aids.

Illustrated in copending patent application U.S. Ser. No. 664,597 pending, filed concurrently herewith, the disclosure of which is totally incorporated herein by reference, is a process for the preparation of inks comprised of i) flushing pigment into a sulfonated polyester resin and which resin possesses a degree of sulfonation of from between about 2.5 and about 20 mol percent;

ii) dispersing the pigmented polyester resin in water at a temperature of from about 40° C. to about 95° C. by a polytron shearing device operating at speeds of from about 100 to about 5,000 revolutions to yield stable pigmented submicron sized particles of from about 5 to about 150 nanometers; and thereafter separating said submicron particles and mixing said submicron particles with water.

BACKGROUND OF THE INVENTION

The present invention is generally directed to toner processes, and more specifically, to aggregation and coalescence processes for the preparation of toner resins, especially polyesters, and toner compositions thereof. In embodiments, the present invention is directed to the economical in situ, chemical or direct preparation of toners and toner resins without the utilization of the known pulverization and/or classification methods, and wherein in embodiments toner compositions with an average volume diameter of from about 1 to about 25, and preferably from 1 to about 10 microns, and narrow GSD of, for example, from about 1.16 to about 1.26, or from about 1.18 to about 1.28 as measured on the Coulter Counter can be obtained, and wherein flushed pigments are selected thus enabling toners with low melting characteristics and which toners contain certain polyester resins. With flushed pigments, there is enabled a superior uniform dispersion of the pigment within the low melt resin, permitting optimum pigment/polymer loading and improved toner quality. Embodiments of the present invention relate to a process for the preparation of dry toner compositions comprised of resin and pigment, and which process comprises flushing a pigment into a sulfonated polyester resin, referred to as a flushed pigmented system, followed by dissipating the flushed pigmented system in water to obtain pigmented particles. The degree of sulfonation during the preparation of the sulfonated polyester resin is a primary factor in determining the size of the toner particles obtained during the dissipating step. The process of the present invention relates to the preparation of toner particles by (i) dissipation of a flushed pigmented sulfonated polyester in warm water (>60° C.) to obtain submicron pigmented sulfonated polyester particles which are in the range of 50 to 200 nanometers in size; followed by heating the resulting mixture below about the glass transition temperature of the sulfonated polyester. In embodiments, there can be added to the mixture resulting a metal salt halide, such as magnesium halide and preferably an aqueous magnesium chloride solution wherein the concentration of the solution is in the range of from about 0.5 to about 5 weight percent; or optionally adding the magnesium chloride solution during the heating from room temperature to a temperature below the resin Tg (chemical toner); or (ii) preparing pigmented toner size particles directly from the flushed pigment system upon dissipating in water where the particles obtained are in the size range of from about 3 to about 7 microns in volume average diameter. The resulting toners can be selected for known electrophotographic imaging methods, printing processes, including color processes, and lithography (direct toner). More specifically, with the processes of the present invention, the use of surfactants can be avoided, for example nonionic surfactant is not needed to disperse the pigment selected, cationic surfactant is not needed to perform the aggregation, and the anionic surfactant selected to stabilize the aggregated particles when heated to 20° to 40° C. above the resin Tg during the coalescence, reference for example U.S. Pat. No. 5,403,693, the disclosure of which is totally incorporated herein by reference, followed by washing to remove surfactants is eliminated (chemical toner). The process of the present invention enables the utilization of polymers obtained by polycondensation reactions, such as polyesters, and more specifically, the sulfonated polyesters as illustrated in U.S. Pat. No. 5,348,832, and copending application U.S. Ser. No. 595,143, now U.S. Pat. No. 5,604,076 the disclosures of which are totally incorporated herein by reference, and which polyesters can be selected for low melting toner. With the processes of the present invention, there are generated flushed pigmented polyesters wherein the polyester has a varying degree of sulfonation which upon dissipation in warm water results in particles of (i) about 3 to about 7 microns in size (direct toner), and (ii) submicron pigmented particles of from about 50 to about 200 nanometers in size, which particles are then aggregated to toner size, about 3 to about 7 microns, wherein the charging and fusing of the toners containing these polyesters is not substantially adversely affected by residual surfactants (chemical toner).

There is illustrated in U.S. Pat. No. 4,996,127, the disclosure of which is totally incorporated herein by reference, a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of the acrylic acid polar group, see Comparative Example I. In U.S. Pat. No. 4,983,488, the disclosure of which is totally incorporated herein by reference, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. Other prior art may include U.S. Pat. Nos. 3,674,736; 4,137,188 and 5,066,560.

Emulsion/aggregation processes for the preparation of toners are illustrated in a number of patents, the disclosures of which are totally incorporated herein by reference, such as U.S. Pat. Nos. 5,290,654, 5,278,020, 5,308,734, 5,346,797, 5,370,963, 5,344,738, 5,403,693, 5,418,108, 5,364,729, and 5,346,797.

SUMMARY OF THE INVENTION

It is an object of the present invention to provide dry toner compositions comprised of a sulfonated polyester resin and flushing a pigment into the resin, which is then dissipated in warm water (>60° C.), resulting in (i) direct preparation of toner size particles; or to provide (ii) submicron pigmented size particles which are then aggregated and coalesced by the addition of alkali halides (chemical toner) and processes thereof with many of the advantages illustrated herein.

In another object of the present invention, there are provided simple and economical chemical processes for the direct preparation of black and colored toner compositions with, for example, excellent pigment dispersion and narrow GSD, and wherein a pigment is flushed into a sulfonated polyester resin, resulting in a uniform distribution of the pigment into the sulfonated polyester, which upon dissipation in warm water (40° C. to 60° C.) and stirring at speeds of 100 to 5,000 rpm, resulting in either pigmented toner size particles or submicron pigmented particles. The degree of sulfonation during the synthesis of the polyester resin determines the particle size obtained upon dissipation. Flushed sulfonated polyester pigmented resin refers to a flushed pigmented system, and can readily be obtained in pressed cakes from Sun Chemicals. Typically, a flushed pigmented system is prepared as follows. First, a presscake of a pigment is generated from an aqueous pigment dispersion by removing water using techniques, such as filtration, to the extent that a presscake of pigment in water is obtained containing 50 to about 70 percent of the pigment solids by weight. Approximately 50 percent of the presscake is then introduced into a reactor containing molten sulfonated polyester resin, accompanied by a high power to volume mixing for a period of of 15 to 30 minutes, whereby the pigment transfers itself spontaneously from the aqueous phase to the organic phase. As the pigment begins to disperse, the remaining 50 percent of pigment presscake is slowly added over a period of an additional 60 to 90 minutes. Alternatively, about 50 percent of the presscake is introduced into a reactor containing a sulfonated resin/solvent (such as toluene, xylene, THF, and the like) solution, accompanied by a high power to volume mixing for a period of 15 to 30 minutes, whereby the pigment transfers itself spontaneously from the aqueous phase to the organic phase. As the pigment begins to disperse, the remaining 50 percent of pigment presscake is slowly added over a period of an additional 60 to 90 minutes. The water molecules separating the primary pigment particles and soft agglomerates in the presscake are displaced by or flushed out by the resin chains, ensuring that an excellent dispersion quality of the pigment is maintained. In embodiments the pigmented polyester resin obtained with the processes of the present invention can easily be dispersed in warm, about 40° C. to about 100° C., water. The polyester flushed pigment mixture can be obtained from Sun Chemicals.

In another object of the present invention, there are provided simple and economical chemical processes for the direct preparation of black and colored toner compositions with, for example, excellent pigment dispersion and narrow GSD, and wherein flushed pigments, especially flushed pigment pressed cakes obtained from Sun Chemicals, are selected, or wherein the pigmented resin is dissipated in hot, about 40° C. to 60° C., water.

Another object of the present invention provides a simple and a direct direct process for the preparation of toner size particles in the range of 3 to 7 microns with a narrow GSD in the range of 1.18 to 1.26, wherein the toner particles are comprised of a pigment and sulfonated polyester resin. The direct preparation of pigmented toner particles involves synthesizing a sulfonated polyester resin having a degree of sulfonation in the range of about 0.5 to about 2.5 mol percent, followed by obtaining a flushed pigmented system as indicated. The flushed system obtained is then dissipated into warm water at a temperature in the range of about 40° C. about 95° C., depending on the resin Tg, by stirring at speed of 100 to 5,000 rpm for a period of 1 to 20 minutes, resulting directly in toner size particles in the range of 3 to 10 microns (direct toner).

Another object of the present invention resides in providing a method for the preparation of submicron pigmented particles in the range of 50 to 200 nanometers in size, which are then aggregated and coalesced in the presence of aqueous magnesium chloride solution. The preparation of pigmented toner particles in the range of 3 to 10 microns comprises (i) synthesizing a sulfonated polyester resin having a degree of sulfonation in the range of 2.5 to 20 mol percent; (ii) followed by obtaining a flushed pigmented system; (iii) thereafter dissipating the flushed pigmented system into warm water, which water is at a temperature in the range of about 40° C. to about 95° C., depending on the resin Tg, by stirring at speed of 100 to 5,000 rpm for a period of 1 to 20 minutes, resulting in submicron pigmented size particles in the range of 50 to 200 nanometers; (iv) optionally adding an aqueous magnesium chloride solution, the concentration of which is in the range of 0.5 to 5 percent by weight of water, to the submicron particles during heating up to a temperature of from about 3° C. to about 10° C. below the resin Tg, or adding the magnesium chloride solution upon reaching a temperature of from about 3° C. to about 10° C. below the resin Tg to induce aggregation over a period of from about 30 to about 90 minutes; and (v) washing and drying the resulting toners. These toners possess excellent pigment dispersion, high gloss, and low melt characteristics.

The chemical toner process of aggregation can be kinetically controlled in that an increase in temperature at which the aggregation/coalescence is executed leads to, or results in larger particle size. Since no extra stabilizer is utilized between the aggregation and coalescence step then the temperature control as well as the rate of the addition of the magnesium chloride solution needs to be monitored precisely (chemical toner).

Another object of the present invention resides in the preparation of 3 to 7 micron pigmented toner particles by directly dissipating the flushed pigmented sulfonated polyester system in warm water of temperatures of 60° C. (direct toner). Moreover, depending on the degree of sulfonation, submicron pigmented sulfonated polyester particles can be formed wherein the submicron pigmented particles act as anionically charged particles, which are then aggregated and coalesced with the addition of an alkali halide. These submicron pigmented sulfonated polyesters are obtained by utilizing a flushed pigmented system, which can be obtained from a number of sources, such as Sun Chemicals. The flushed pigmented system can also be obtained from a molten flushing process. For this process, examples of the alkali halides that may be selected include berylium chloride, berylium bromide, berylium iodide, magnesium chloride, magnesium bromide, magnesium iodide, calcium chloride, calcium bromide, calcium iodide, strontium chloride, strontium bromide, strontium iodide, barium chloride, barium bromide, and barium iodide (chemical process).

Another object of the present invention resides in emulsion/aggregation/coalescence processes for the chemical preparation of toners wherein the use of surfactants are avoided and wherein flushed pigments are selected, and which flushing pigments can be obtained from a number of sources, such as Sun Chemicals, or wherein the flushing pigments can be prepared by displacing the water in the pigment presscake with either molten sulfonated polyester or a sulfonated polyester/solvent mixture, removing excess water by vacuum drying, dispersing the toner pigment in warm (>60° C.) water with a polytron, and wherein the pigment loading can be varied to be 45 to 50 weight percent, and wherein the pigmented particles are submicron in size, for example from about 30 to about 150 nanometers (chemical toner).

In a further object of the present invention there is provided a process for the preparation of toner compositions with an average particle volume diameter of from between about 1 to about 20 microns, and preferably from about 1 to about 7 microns, and with a narrow GSD of from about 1.2 to about 1.3 and preferably from about 1.16 to about 1.25 as measured by a Coulter Counter.

In a further object of the present invention there is provided a process for the preparation of toners with particle size distribution which can be improved from 1.4 to about 1.16 as measured by the Coulter Counter by increasing the temperature of aggregation from about 25° C. to about 45° C. (chemical toner).

Moreover, in a further object of the present invention there is provided a process for the preparation of toner compositions which after fixing to paper substrates results in images with a gloss of from 20 GGU (Gardner Gloss Units) up to 70 GGU as measured by Gardner Gloss meter matching of toner and paper.

In another object of the present invention there is provided a composite toner of sulfonated polymeric resin with pigment and optional charge control agent in high yields of from about 90 percent to about 100 percent by weight of toner without resorting to classification.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

These and other objects of the present invention are accomplished in embodiments by the provision of toners and processes thereof. In embodiments of the present invention, there are provided processes for the economical preparation of toner compositions comprising a sulfonated polyester flushed with a pigment, and which product is then dispersed into warm water to either (i) obtain the desired toner size particles directly, (ii) obtain submicron pigmented particles, which are then aggregated to toner size by adding an alkali halide, such as magnesium chloride, while heating to a temperature in the range of about 3° to about 10° C. below the resin Tg; or heating the submicron particles to a temperature in the range of 3° C. to 10° C. below the resin Tg while stirring, followed by the addition of the magnesium chloride solution to enhance the aggregation; followed by further heating for a period of 30 to 90 minutes to enable coalescence of the submicron pigmented particles, and thereafter washing with, for example, water to remove any residual salts, and then drying.

Embodiments of the present invention include a process for the preparation of toner particles comprised of resin and pigment, and which process comprises i) flushing a pigment into a sulfonated polyester, and thereafter adding the product resulting to warm water, which water is at a temperature of from about 40° C. to about 95° C.; a process for the preparation of toner compositions comprised of flushing pigment into a sulfonated polyester resin, and which resin has a degree of sulfonation of from between about 0.5 and about 2.5 mol percent based on the repeat unit of the polymer;

ii) dispersing the resulting pigmented sulfonated polyester resin in warm water, which water is at a temperature of from about 40° C. to about 95° C., and which dispersing is accomplished by a high speed shearing polytron device operating at speeds of from about 100 to about 5,000 revolutions per minute thereby enabling the formation of toner sized particles, and which particles are of a volume average diameter of from about 3 to about 10 microns with a narrow GSD;

iii) optionally recovering said toner composition, or said toner particles by filtration;

iv) drying said toner particles by vacuum; and v) adding to said dry toner particles charge additives and flow aids; a process for the preparation of toner compositions comprised of i) flushing pigment into a sulfonated polyester resin, and which resin has a degree of sulfonation of from between about 0.5 and 2.5 mol percent based on the repeat unit, or segment of the polymer;

ii) dispersing the resulting pigmented sulfonated polyester resin in warm water, which water is at a temperature of from about 40° to about 95° C., and which dispersing is accomplished with a high speed shearing device; and iii) optionally recovering said toner particles by filtration;

iv) drying said toner particles by vacuum (chemical toner); a process for the preparation of toner compositions comprised of i) flushing a pigment into a sulfonated polyester resin, and which resin has a degree of sulfonation of from between about 2.5 and 20 mol percent based on the repeat unit of the polymer;

ii) dispersing the resulting sulfonated pigmented polyester resin into warm water, which water is at a temperature of from about 40° C. to about 95° C., by a high speed shearing polytron device operating at speeds of from about 100 to about 5,000 revolutions per minute thereby enabling the formation of stable toner sized submicron particles, and which particles are of a volume average diameter of from about 5 to about 150 nanometers;

iii) allowing the resulting solution to cool to from about 5° C. to about 10° C. below the glass transition temperature of said pigmented sulfonated polyester resin;

iv) adding an alkali halide solution, which solution contains from about 0.5 percent to about 5 percent by weight of water, followed by stirring and heating from room temperature to a temperature below the resin Tg to induce aggregation of said submicron pigmented particles to obtain toner size particles of from about 3 to about 10 microns in volume average diameter and with a narrow GSD; or subsequently stirring and heating to a temperature below the resin Tg, followed by the addition of alkali metal halide until the desired toner size of from about 3 to about 10 microns in volume average diameter and with a narrow GSD is achieved; and v) recovering said toner by filtration and washing with cold water, drying said toner particles by vacuum, and thereafter optionally blending charge additives and flow additives; and a process for the preparation of toner compositions comprised of i) flushing a pigment into a sulfonated polyester resin;

ii) dispersing the resulting sulfonated pigmented polyester resin into warm water, which water is at a temperature of from about 40° C. to about 95° C., by a high speed shearing device operating at speeds of from about 100 to about 5,000 revolutions per minute thereby enabling the formation of stable toner sized submicron particles, and which particles are of a volume average diameter of from about 5 to about 150 nanometers;

iii) permitting the resulting solution to cool to from about 5° C. to about 10° C. below the glass transition temperature of said pigmented sulfonated polyester resin; and iv) adding a alkali halide solution, which solution contains from about 0.5 percent to about 5 percent by weight of water, followed by stirring and heating from room temperature to a temperature below the resin Tg to induce aggregation of said submicron pigmented particles to obtain toner size particles of from about 3 to about 10 microns in volume average diameter and with a narrow GSD; followed by the addition of alkali metal halide until the desired toner size of from about 3 to about 10 microns in volume average diameter is achieved; and optionally recovering said toner by filtration and washing with cold water, drying said toner by vacuum.

Various known colorants or pigments together with the polyester resin obtained and present in the toner in an effective amount of, for example, from about 1 to about 65, and preferably from about 2 to about 35 percent by weight of the toner, and preferably in an amount of from about 1 to about 15 weight percent, include carbon black like REGAL 330®; magnetites, such as Mobay magnetites MO8029™, MO8060™, and the like. As colored pigments, there can be selected known cyan, magenta, yellow, red, green, brown, blue or mixtures thereof. Specific examples of pigments include phthalocyanine HELIOGEN BLUE L6900™, D6840™, D7080™, D7020™, cyan 15:3, magenta Red 81:3, Yellow 17, the pigments of U.S. Pat. No. 5,556,727, the disclosure of which is totally incorporated herein by reference, and the like. Examples of specific magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of specific cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative specific examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. All the pigments selected are flushed pigments as indicated herein and not dry pigments.

More specifically, pigment examples include Pigment Blue 15:3 having a Color Index Constitution Number of 74160, magenta pigment Pigment Red 81:3 having a Color Index Constitution Number of 45160:3, and Yellow 17 having a Color Index Constitution Number of 21105.

The toner may also include known charge additives in effective amounts of, for example, from 0.1 to 5 weight percent such as alkyl pyridinium halides, bisulfates, and the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surface additives that can be added to the toner compositions after washing or drying include, for example, metal salts, metal salts of fatty acids, colloidal silicas, fumed silicas, mixtures thereof, and the like, which additives are usually each present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and flow aids, such as fumed silicas, like AEROSIL R972® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,660, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

EXPERIMENTAL

Preparation of Sulfonated Polyesters

Preparation of Linear Low Sulfonated Polyester A:

A linear low sulfonated random copolyester resin containing on a mol percent basis of the polyester polymer repeat unit of approximately 0.475 of terephthalate, 0.025 of sodium sulfoisophthalate, 0.475 of 1,2-propanediol, and 0.025 of diethylene glycol is prepared as follows. In a one liter Parr reactor equipped with a bottom drain valve, double turbine agitator, and distillation receiver with a cold water condenser were charged 388 grams of dimethylterephthalate, 31.23 grams of sodium dimethylsulfoisophthalate, 304.43 grams of 1,2-propanediol (1 mole excess of glycols), 22.30 grams of diethylene glycol, (1 mole excess of glycols), and 0.8 gram of butyltin hydroxide oxide as the catalyst. The reactor was then heated to 165° C. with stirring for 3 hours whereby 115 grams of distillate were collected in the distillation receiver, and which distillate was comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced from atmospheric pressure to about 260 Torr over a one hour period, and then reduced to 5 Torr over a two hour period with the collection of approximately 122 grams of distillate in the distillation receiver comprised of approximately 97 percent by volume of 1,2-propanediol and 3 percent by volume of methanol as measured by the ABBE refractometer. The pressure was then further reduced to about 1 Torr over a 30 minute period whereby an additional 16 grams of 1,2-propanediol were collected. The reactor was then purged with nitrogen to atmospheric pressure, and the polymer discharged through the bottom drain onto a container cooled with dry ice to yield 460 grams of 2.5 mol percent (percent sulfonated)sulfonated-polyester resin, copoly(1,2-propylene-diethylene)terephthalate-copoly (sodium sulfoisophthalate dicarboxylate). The 2.5 mol percent sulfonated-polyester resin glass transition temperature was measured to be 53.7° C. (onset) utilizing the 910 Differential Scanning Calorimeter available from E. I. DuPont operating at a heating rate of 10° C. per minute. The number average molecular weight was measured to be 1,570 grams per mole, and the weight average molecular weight was measured to be 3180 grams per mole using tetrahydrofuran as the solvent. This resin was used to prepare toner particles in Example IA and IB.

Preparation of Flushed Pigmented Sulfonated Polyesters

Molten Flushed Process:

To a sample (200 grams) of the molten polyester A (>150° C.) in an explosion proof stainless steel batch mixer equipped with a high power to volume ratio sigma blade was rapidly added 50 percent of a Sun Fast cyan 15:3 wet presscake, available from Sun Chemicals, which was comprised of 50 to 70 percent pigment solids by weight. Initial mixing was continued for 15 minutes, after which the remaining 50 percent of the presscake was slowly added to the reaction mixture over a 2 hour period. The reactor was then allowed to cool to 50° C. The water at the top of the reactor was decanted and the remaining water removed by vacuum drying. Pigmented polyester A was heated to 175° C. and then discharged. The resulting composition of the dry toner resin prepared by this process was 85 percent of sulfonated polyester A and 15 percent of the flushed cyan pigment 15:3.

Solvent Flushed Process:

To a room temperature, about 25° C., THF solution of the polyester A (200 grams of resin in 200 milliliters of THF) in an explosion proof stainless steel batch mixer equipped with a high power to volume ratio sigma blade was rapidly added 50 percent of a Sun Fast cyan wet presscake, available from Sun Chemicals. Initial mixing was continued for 15 minutes, after which the remaining 50 percent of the presscake was slowly added to the reaction mixture over a 2 hour period. The reactor was then allowed to cool to 50° C. The water at the top of the reactor was decanted and the remaining water removed by vacuum drying. The product resulting was heated to 175° C. and then discharged. The composition of the resulting dry toner resin prepared by this process was 85 percent of sulfonated polyester A and 15 percent of the flushed cyan pigment.

Preparation of Toner

Example IA

Using a Molten Flushed Pigmented Sulfonated Polyester:

A 200 gram sample of the pigmented linear sulfonated polyester A with a low sulfonation (2.5 mol percent) prepared by the molten flushing process illustrated herein was dissipated within 20 minutes by the addition of pigmented polyester A with stirring in 500 milliliters of hot water (75° C.). Stable toner sized particles (4 microns) with an acceptable GSD (1.25) comprised of 8.5 parts by weight of sulfonated polyester and 1.5 parts of cyan, 15:3 flushed pigment by weight, were obtained. The toner particles were recovered by first filtering and then vacuum drying the sample. Toners obtained by this process exhibit a fusing performance which was comparable to toners obtained by conventional melt mixing processes.

Example IB

Using a Solvent Flushed Pigmented Sulfonated Polyester:

A 200 gram sample of the pigmented linear sulfonated polyester A with a degree of sulfonation of 2.5 mol percent prepared by the solvent flushing process illustrated herein was dissipated readily within 20 minutes by the addition of the pigmented polyester A material, with stirring, to 500 milliliters of hot water (75° C.). Stable toner sized particles (5 microns) with an acceptable GSD (1.25) comprised of 8.5 parts by weight of sulfonated polyester and 1.5 parts of cyan flushed pigment were obtained. The toner particles were recovered by first filtering and then vacuum drying the sample. Toners obtained by this process exhibited a fusing performance which was comparable to toners obtained by conventional process.

Other modifications of the present invention may occur to those skilled in the art subsequent to a review of the present application and these modifications, including equivalents thereof, are intended to be included within the scope of the present invention.

What is claimed is:

1. A process for the preparation of toner comprised of i) flushing pigment into a sulfonated polyester resin, and which resin has a degree of sulfonation of from between about 0.5 and about 2.5 mol percent based on the repeat unit of the polymer;

ii) dispersing the resulting pigmented sulfonated polyester resin in warm water, which water is at a temperature of from about 40° to about 95° C., and which dispersing is accomplished by a high speed shearing polytron device operating at speeds of from about 100 to about 5,000 revolutions per minute thereby producing toner sized particles, and which particles are of a volume average diameter of from about 3 to about 10 microns with a narrow GSD in the range of from about 1.18 to about 1.28;

iii) recovering said toner by filtration;

iv) drying said toner by vacuum; and v) optionally addling to said dry toner charge additives and flow aids.

2. A process in accordance with claim 1 wherein said sulfonated polyester resin is in a molten form and is heated prior to flushing the pigment into the sulfonated polyester resin to obtain a flushed pigmented sulfonated polyester resin.

3. A process in accordance with claim 2 wherein said sulfonated polyester resin is heated at a temperature of from about 175° C. to about 200° C.

4. A process in accordance with claim 2 wherein the toner composition particle size is from 3 to about 7 microns.

5. A process in accordance with claim 2 wherein said toner is filtered, washed with water and dried.

6. A process in accordance with claim 1 wherein said sulfonated polyester resin is dissolved into a solvent prior to flushing the pigment into the sulfonated polyester resin to obtain a flushed pigmented sulfonated polyester resin.

7. A process in accordance with claim 6 wherein said sulfonated polyester resin is dissolved into a polar solvent.

8. A process in accordance with claim 7 wherein the pigment to be flushed is added to said solution containing the sulfonated polyester resin followed by vigorous stirring for a period of from about 10 minutes to about 120 minutes.

9. A process in accordance with claim 8 wherein said pigmented sulfonated polyester mixture resulting is cooled, water and solvent decanted, followed by vacuum drying.

10. A process in accordance with claim 8 wherein said pigmented sulfonated polyester resin is heated to between 150° C. to 175° C. and discharged.

11. A process in accordance with claim 1 wherein the pigment to be flushed is added to a molten sulfonated polyester resin followed by vigorous stirring for a period of from about 10 minutes to about 120 minutes.

12. A process in accordance with claim 11 wherein said pigmented sulfonated polyester resin mixture resulting is cooled, water decanted, followed by vacuum drying.

13. A process in accordance with claim 12 wherein said pigmented sulfonated polyester resin is heated to between from about 150° C. to about 175° C. and discharged.

14. A process in accordance with claim 1 wherein the polyester is a random sulfonated copolyester comprised of, on a mol percent basis of the polymer repeat unit, approximately 0.475 of terephthalate/0.025 of sodium sulfoisophthalate/0.475 of 1,2-propanediol/0.025 of diethylene glycol, and which polyester possesses an $M_w$ of about 3,180, an $M_n$ of about 1,570, and a Tg of about 53.7° C.

15. A process in accordance with claim 14 wherein the toner obtained is washed with water.

16. A process in accordance with claim 1 wherein the pigment is carbon black, magnetite, cyan, yellow, magenta, or mixtures thereof.

17. A process in accordance with claim 1 wherein there is added to the surface of the formed toner product metal salts, metal salts of fatty acids, silicas, metal oxides, or mixtures thereof, each in an amount of from about 0.1 to about 10 weight percent of the obtained toner particles.

* * * * *